US006013602A

United States Patent [19]

Kamikubo et al.

[11] Patent Number: 6,013,602

[45] Date of Patent: Jan. 11, 2000

[54] THERMAL TRANSFER IMAGE-RECEIVING SHEET

[75] Inventors: Yoshinori Kamikubo; Satoshi Narita, both of Shinjuku-Ku, Japan

[73] Assignee: Dai Nippon Printing Co., Ltd.

[21] Appl. No.: 09/115,739

[22] Filed: Jul. 15, 1998

[30] Foreign Application Priority Data

Jul. 22, 1997 [JP] Japan ..... 9-210155

[51] Int. Cl.[7] ..... B41M 5/035; B41M 5/38

[52] U.S. Cl. ..... 503/227; 428/195; 428/423.1; 428/522; 428/913; 428/914

[58] Field of Search ..... 8/471; 428/195, 428/423.1, 522, 913, 914; 503/227

[56] References Cited

FOREIGN PATENT DOCUMENTS

| | | | |
|---|---|---|---|
| 0 850 780 A1 | 1/1988 | European Pat. Off. | 503/227 |
| 0 652 114 A1 | 5/1995 | European Pat. Off. | 503/227 |
| 0 718 113 A2 | 6/1996 | European Pat. Off. | 503/227 |
| 0 816 113 A1 | 1/1998 | European Pat. Off. | 503/227 |

OTHER PUBLICATIONS

Patent Abstracts Of Japan; vol. 097, No. 008; Aug. 29, 1997 & JP 09 099651 A (DAI Nippon Printing Co LTD); Apr. 15, 1997 *abstract*.

Patent Abstracts Of Japan; vol. 018, No. 682 (M–1729); Dec. 22, 1994 & JP 06 270559 A (DAI Nippon Printing Co LTD); Sep. 27, 1994 *abstract*.

Patent Abstracts Of Japan; vol. 018, No. 479 (M–1669); Sep. 7, 1994 & JP 06 155942 A (Mitsubishi Paper Mills LTD); Jun. 3, 1994 *abstract*.

*Primary Examiner*—Bruce H. Hess
*Attorney, Agent, or Firm*—Parkhurst & Wendel, L.L.P.

[57] ABSTRACT

A thermal transfer image-receiving sheet is provided which does not cause destruction of a heat-insulating, porous layer at the time of formation of a dye-receptive layer, has no fear of the dye-receptive layer being separated, and in addition can produce a printed image having satisfactory image quality and density. The thermal transfer image-receiving sheet comprise: a paper substrate; and, provided on the substrate in the following order, a heat-insulating, porous layer composed mainly of a resin, a barrier layer, and a dye-receptive layer, the barrier layer comprising at least a mixture of polyvinyl alcohol with a polyurethane resin, the weight ratio on solid basis of polyvinyl alcohol to polyurethane resin being 10:100 to 80:100.

3 Claims, No Drawings

THERMAL TRANSFER IMAGE-RECEIVING SHEET

BACKGROUND OF THE INVENTION

This invention relates to a thermal transfer image-receiving sheet which, in use, is superposed onto a thermal dye donor sheet, and more particularly to a thermal transfer image-receiving sheet having texture similar to plain paper.

Various thermal transfer recording systems are known in the art. Among them, a thermal dye transfer system, wherein a sublimable dye as a colorant is transferred, using a thermal head capable of generating heat in response to a recording information, onto an image-receiving sheet to produce an image.

According to this recording system, since a sublimable dye is used as a colorant, density gradation can be controlled as desired and can reproduce a full-color image of an original image. Further, the formed dye image is very sharp and highly transparent and hence is excellent in reproduction of halftone and gradation, realizing a high-quality image comparable to a silver-salt photographic image.

A plastic sheet, a laminate sheet composed of a plastic sheet and paper or the like, or a synthetic paper or the like has been used as a thermal transfer image-receiving sheet in the thermal dye transfer system. In order to spread utilization of the thermal dye transfer system to general offices, use of plain papers, such as coated paper (art paper), cast coated paper, and paper for PPC, as a substrate sheet for the image-receiving sheet has been proposed in the art. In forming a dye-receptive layer on the surface of the plain paper as the substrate sheet, good heat insulating properties are required of the substrate sheet from the viewpoint of improving the sensitivity in printing. In order to improve the heat insulating properties, a proposal has been made on provision of a heat insulating layer between the substrate sheet and the dye-receptive layer (Japanese Patent Laid-Open Publication No. 155942/1994).

In a thermal transfer image-receiving sheet comprising the conventional paper substrate and, provided on the substrate in the following order, a heat-insulating, porous layer composed mainly of a resin and a dye-receptive layer, formation of the dye-receptive layer by coating a solution of a resin in an organic solvent poses a problem that, due to poor solvent resistance of the heat-insulating, porous layer, the porous structure of the heat-insulating, porous layer is destroyed by the organic solvent in the course of coating of the coating liquid for the dye-receptive layer, making it impossible to print an image having satisfactory quality and density.

Provision of a solvent barrier layer comprising polyvinyl alcohol between the porous layer and the dye-receptive layer is considered effective for solving the above problem (Japanese Patent Laid-Open Publication No. 144394/1986). In this case, the adhesion between polyvinyl alcohol and the resin used in the dye-receptive layer is so low that the adhesion between the barrier and the dye-receptive layer is adversely affected.

Accordingly, an object of the present invention is to solve the above problems of the prior art and to provide a thermal transfer image-receiving sheet which does not cause destruction of a heat-insulating, porous layer at the time of formation of a dye-receptive layer, has no fear of the dye-receptive layer being separated, and in addition can produce a printed image having satisfactory image quality and density.

DISCLOSURE OF INVENTION

The above object of the present invention can be attained by a thermal transfer image-receiving sheet comprising: a pain paper substrate; and, provided on the substrate in the following order, a heat-insulating, porous layer composed mainly of a resin, a barrier layer, and a dye-receptive layer, the barrier layer comprising at least a mixture of polyvinyl alcohol with a polyurethane resin, the weight ratio on solid basis of polyvinyl alcohol to polyurethane resin being 10:100 to 80:100.

According to the present invention, in a thermal transfer image-receiving sheet using a plain paper substrate, the formation of the barrier layer from at least a specific mixture of polyvinyl alcohol with a polyurethane resin can provide a thermal transfer image-receiving sheet which does not cause destruction of a heat-insulating, porous layer at the time of formation of a dye-receptive layer, has no fear of the dye-receptive layer being separated, and in addition can produce a printed image having satisfactory image quality and density.

BEST MODE FOR CARRYING OUT THE INVENTION

The present invention will be described in more detail with reference to the following preferred embodiments.

The thermal transfer image-receiving sheet according to the present invention basically comprises a substrate, a heat-insulating, porous layer composed mainly of a resin, a barrier layer, and a dye-receptive layer. The substrate and the layers constituting the thermal transfer image-receiving sheet will be described.

Substrate

Commonly used papers can be used as the substrate in the present invention. Papers as the substrate are not particularly limited, and examples thereof include wood-free papers, art papers, lightweight coated papers, slightly coated papers, coated papers, cast coated papers, synthetic resin- or emulsion-impregnated papers, synthetic rubber latex-impregnated papers, papers with synthetic resin internally added thereto, and papers for thermal transfer. Among them, wood-free papers, lightweight coated papers, slightly coated papers, coated papers, and papers for thermal transfer are preferred. The thickness of the substrate is 40 to 300 $\mu$m, preferably 60 to 200 $\mu$m.

Heat-insulating, Porous Layer

According to the present invention, the heat-insulating, porous layer composed mainly of a resin is preferably a layer which has been formed from a resin and a thermally expansive microsphere, or a layer which has been formed from a resin and a capsular empty particle.

The thermally expansive microsphere is a microcapsule prepared by encapsulating a low-boiling point liquid, such as butane or pentane, with a resin, such as polyvinylidene chloride or polyacrylonitrile. The microsphere is foamed by heating after the formation of an heat insulating layer and, upon foaming, provides a porous layer having high cushioning properties and heat insulating properties.

On the other hand, the capsular empty particle comprises a resin, as a wall material, such as polyacrylonitrile or styrene/acrylic copolymer, and water provided in a space defined by the wall, and, upon exposed to heat during drying of a coating thereof, water is evaporated to render the interior of the resin particle empty to provide a porous layer having high cushioning properties and heat insulating properties.

The thermally expansive microsphere layer causes foaming in the course of heat drying after coating of a coating liquid, and, hence, when a coating liquid for a barrier layer and a coating liquid for a dye-receptive layer described below are coated and dried on the resultant heat-insulating, porous layer, there is a fear of irregularities being created on the surface of the dye-receptive layer. Therefore, in order to provide a dye-receptive layer surface, which has small irregularities and permits a highly even image to be transferred, the heat-insulating, porous layer is preferably formed using the capsular empty particle.

The average diameter of empty particles is preferably 0.5 to 10 μm. When the average particle diameter is less than 0.5 μm, the effect of improving the sensitivity in printing by virtue of heat insulating properties of the porous layer is low. On the other hand, when the average particle diameter exceeds 10 μm, the surface smoothness after the provision of the barrier layer and the dye-receptive layer on the porous layer is lowered.

The amount of the empty particle used is preferably in the range of from 20 to 80 parts by weight based on 100 parts by weight of the resin for the heat-insulating, porous layer. When the amount is less than 20 parts by weight, the effect of improving the sensitivity in printing by virtue of heat insulating properties of the porous layer is low. On the other hand, when the amount exceeds 80 parts by weight, the coating strength of the porous layer is lowered.

The empty particle has low resistance to an organic solvent, and, when an organic solvent is used in coating of a coating liquid for an heat-insulating, porous layer, the partition wall of the empty particle is destroyed, making it impossible to provide desired heat insulating properties. For this reason, the coating liquid for the heat-insulating, porous layer is preferably an aqueous coating liquid that does not have an adverse effect on the empty particle. Resins usable for the heat-insulating, porous layer include conventional resins, such as urethane resin, acrylic resin, methacrylic resin, and modified olefin resin, and a mixture of two or more of the above resins. The thickness of the heat-insulating, porous layer is preferably 5 to 50 μm. When the thickness is less than 5 μm, desired heating insulating properties cannot be provided. On the other hand, a thickness exceeding 50 μm results in saturated heat insulating effect and is also cost-ineffective.

Barrier Layer

According to the present invention, a barrier layer is provided between the heat-insulating, porous layer and the dye-receptive layer. The barrier layer serves to protect the empty particle in the heat-insulating, porous layer against the organic solvent used in coating of the dye-receptive layer. The barrier layer should have satisfactory interfacial adhesion to both the underlying heat-insulating, porous layer and the overlying dye-receptive layer. According to the present invention, a mixture of polyvinyl alcohol, having barrier properties against the organic solvent, with a polyurethane resin having good adhesion to the dye-receptive layer is used as the resin for the barrier layer.

Representative examples of polyvinyl alcohol useful in the present invention include Gosenol NH-20$^R$, Gosenol NH-26$^R$, Gosenol C-500$^R$, Gosenol KH-20$^R$, Gosenol KM-11$^R$, Gosenol KP-08$^R$, and Gosenol NK-05$^R$ (tradenames, manufactured by Nippon Synthetic Chemical Industry Co., Ltd., Japan).

Representative examples of polyurethane resin useful in the present invention include HYDRAN AP-10$^R$, HYDRAN AP-20$^R$, HYDRAN AP-40$^R$, HYDRAN HW-301$^R$, HYDRAN HW-101H$^R$ (tradenames, manufactured by Dainippon Ink and Chemicals, Inc., Japan).

The polyvinyl alcohol and the polyurethane resin are used as a mixture. In the present invention, the mixing ratio of polyvinyl alcohol to polyurethane resin is in the range of from 10:100 to 80:100 (weight ratio). When the mixing ratio is less than 10:100, desired barrier properties against the organic solvent cannot be provided. In this case, the empty particle is destroyed at the time of formation of the dye-receptive layer, making it impossible to provide a heat-insulating, porous layer having desired heat insulating properties. Further, the quality of the printed image is lowered. When the mixing ratio exceeds 80:100, the interfacial adhesion between the barrier layer and the dye-receptive layer is unsatisfactory.

The coverage of the barrier layer is preferably in the range of from 1 to 20 g/m$^2$. When the coverage is less than 1 g/m$^2$, the barrier properties against the organic solvent is unsatisfactory. On the other hand, when the coverage exceeds 20 g/m$^2$, the heat insulating effect of the porous layer cannot be unfavorably attained.

Dye-receptive Layer

The dye-receptive layer provided on the barrier layer serves to receive a sublimable dye transferred from a thermal transfer sheet and to hold the formed image. Resins usable for the dye-receptive layer include, for example, polyolefin resins, such as polypropylene, polyvinyl chloride, vinyl chloride/vinyl acetate copolymer, ethylene/vinyl acetate copolymer, halogenated polymers, such as polyvinylidene chloride, vinyl polymers, such as polyvinyl acetate and polyacrylic esters, polyester resins, such as polyethylene terephthalate and polybutylene terephthalate, polystyrene resin, polyamide resin, resin of copolymer of olefin, such as ethylene or propylene, with other vinyl monomer, ionomers, cellulosic resins, such as cellulose diacetate, and polycarbonate. Vinyl resin and polyester resin are particularly preferred.

In forming a dye-receptive layer from the above resin, incorporation of a release agent into the resin is preferred from the viewpoint of preventing fusing between the thermal transfer sheet and the dye-receptive layer at the time of thermal transfer. Preferred release agents usable herein include silicone oils, phosphoric ester surfactants, and fluorosurfactants. Among them, silicone oils are preferred.

Preferred silicone oils include modified silicone oils, such as epoxy-modified, alkyl-modified, amino-modified, carboxyl-modified, alcohol-modified, fluorine-modified, alkyl aralkyl polyether-modified, epoxy-polyether-modified, and polyether-modified silicone oils. These release agents are used alone or as a mixture of two or more.

The amount of the release agent added is preferably in the range of from 0.5 to 30 parts by weight based on 100 parts by weight of the resin for the dye-receptive layer. When the amount is outside the above range, there is a fear of problems, such as fusing of the dye-receptive layer to the thermal transfer sheet or lowered sensitivity in printing, being posed. Addition of the release agent to the dye-receptive layer permits the release agent to bleed out on the surface of the dye-receptive layer, after transfer, to form a release layer.

The dye-receptive layer may be formed on the surface of the barrier layer by coating a solution or dispersion of the above resin, with necessary additives, such as a release agent, incorporated therein, dissolved or dispersed in a suitable organic solvent, for example, by gravure printing, screen printing, reverse roll coating or other forming means using a gravure plate and drying the coating.

In the formation of the dye-receptive layer, optical brighteners, titanium oxide, zinc oxide, kaolin clay, calcium carbonate, finely divided silica, or other pigments or fillers may be added from the viewpoint of improving the whiteness of the dye-receptive layer to further enhance the sharpness of the transferred image. Although the dye-receptive layer may have any desired thickness, it is generally 1 to 50 μm.

Other Layers

In addition to the above substrate, heat-insulating, porous layer, barrier layer, and dye-receptive layer, the following optional layers may be incorporated in the thermal transfer image-receiving sheet of the present invention.

Undercoat

When a heat-insulating, porous layer is provided between the dye-receptive layer and the substrate, preferably, an undercoat is provided on the substrate. The undercoat, when a coating liquid for the heat-insulating, porous layer is coated on the substrate, prevents penetration of the coating liquid into the substrate, permitting the heat-insulating, porous layer to be formed to a desired thickness. In foaming the heat-insulating, porous layer by heating, the expansion ratio can be enhanced, the cushioning properties of the whole image-receiving sheet can be improved, and the amount of the coating liquid for the heat-insulating, porous layer can be reduced for forming a heat-insulating, porous layer having desired thickness, which is cost-effective.

Intermediate Layer

When the foaming agent in the heat-insulating, porous layer is foamed, uneven irregularities on the order of several tens of pm are created on the surface of the heat-insulating, porous layer. This in turn causes the dye-receptive layer provided thereon to unfavorably have surface irregularities. When an image is formed on the image-receiving sheet, the resultant image suffers from dropouts and voids and does not have high sharpness and resolution. Provision of an intermediate layer formed of a flexible or elastic material on the barrier layer overlying the heat-insulating, porous layer can eliminate the problem associated with surface irregularities of the heat-insulating, porous layer. The provision of the intermediate layer can realize an image-receiving sheet wherein, even when the dye-receptive layer has surface irregularities, the surface irregularities do not influence the quality of the printed image. The intermediate layer is formed of a highly flexible, elastic resin, specifically urethane resin, vinyl acetate resin, acrylic resin, or a copolymer thereof, or a blend of these resins.

Inorganic pigments, such as calcium carbonate, talc, kaolin, titanium oxide, zinc oxide, and other conventional inorganic pigments, and optical brighteners may be incorporated into the intermediate layer or the heat-insulating, porous layer in order to impart opaqueness or whiteness or to regulate the texture of the thermal transfer image-receiving sheet. The proportion of the pigment or the like is preferably 10 to 200 parts by weight based on 100 parts by weight of the resin on a solid basis. When the proportion is less than 10 parts by weight, the contemplated effect is small. On the other hand, a proportion exceeding 200 parts by weight results in poor dispersion stability of the pigment or the like or otherwise makes it impossible to provide properties inherent in the resin. The coverage of the intermediate layer is preferably in the range of from 1 to 20 g/m$^2$. When the coverage is less than 1 g/m$^2$, the cell protective function is unsatisfactory. On the other hand, when the coverage exceeds 20 g/m$^2$, heat-insulating/cushioning properties and the like cannot be unfavorably attained by the heat-insulating, porous layer.

Backside Layer

A slippery backside layer may be provided on the image-receiving sheet in its side remote from the dye-receptive layer according to the carrying system of the image-receiving sheet of the printer used. An inorganic or organic filler may be dispersed in the resin constituting the backside layer in order to impart slip properties to the backside layer. A conventional resin or a mixture of two or more conventional resins may be used as the resin for the slippery backside layer. Alternatively, a slip or release agent, such as silicone, may be added to the backside layer. The coverage of the backside layer is preferably 0.05 to 3 g/m$^2$.

Thermal transfer sheets used, for thermal transfer, in combination with the above image-receiving sheet include a thermal dye transfer sheet for use in a thermal dye transfer system and a thermal ink transfer sheet, comprising a substrate and, coated thereon, a hot-melt ink layer of a pigment or the like, held by a hot-melt binder, which upon heating the ink layer, in its entirety, is transferred to an object.

In the thermal transfer, thermal energy may be applied by any conventional means. For example, a desired image can be formed by applying a thermal energy of about 5 to 100 mJ/mm$^2$ through the control of a recording time by means of a recording device, such as a thermal printer (for example, m2710, manufactured by Sumitomo 3M Ltd.)

The present invention will be described in more detail with reference to the following examples and comparative examples. In the following description, all "parts" or "%" are by weight.

EXAMPLES 1 to 5 AND COMPARATIVE EXAMPLES 1, 2, 4 AND 5

A coated paper having a basis weight of 127.9 g/m$^2$ (OK Royal Coat, manufactured by New Oji Paper Co., Ltd., Japan) was provided as a substrate. A coating liquid, for a porous layer, having the following composition was gravure-coated at a coverage of 20 g/m$^2$ (dry basis; the same shall apply hereinafter) on the substrate, and the coating was dried by a hot air drier to form a porous layer.

Coating Liquid for Heat-insulating, Porous Layer

| | |
|---|---|
| Acryl/styrene copolymer emulsion (manufactured by Nippon Carbide Industries Co., Ltd., Japan RX 832-1, solid content 55%) | 30 parts |
| Empty resin particle (manufactured by Rohm & Haas, Ropaque HP 91, particle diameter 1.0 μm) | 100 parts |
| Solvent (water) | 10 parts |

A coating liquid, for a barrier layer, having the following composition (solid content ratio) was gravure-coated at a coverage of 3 g/m$^2$ on the porous layer, and the coating was dried by a hot air drier to form a barrier layer.

Barrier Layer

TABLE 1

Composition of coating liquid for barrier layer

| Component | Comp. Ex. 1 | Ex. 1 | Ex. 2 | Ex. 3 | Comp. Ex. 2 | Comp. Ex. 4 | Comp. Ex. 5 |
|---|---|---|---|---|---|---|---|
| Polyvinyl alcohol*1 | 5 parts | 10 parts | 50 parts | 80 parts | 100 parts | 100 parts | 0 part |
| Polyurethane *2 | 100 parts | 100 parts | 100 parts | 100 parts | 100 parts | 0 part | 100 parts |
| Solvent (water/IPA = 3/1) | 21 parts | 22 parts | 30 parts | 36 parts | 40 parts | 20 parts | 20 parts |

*1: Polyvinyl alcohol (KM-11, manufactured by Nippon Kagaku Kogyo Co., Ltd., Japan)

TABLE 1-continued

| Composition of coating liquid for barrier layer | | | | | | | |
|---|---|---|---|---|---|---|---|
| Component | Comp. Ex. 1 | Ex. 1 | Ex. 2 | Ex. 3 | Comp. Ex. 2 | Comp. Ex. 4 | Comp. Ex. 5 |

*2: Polyurethane emulsion (manufactured by Dainippon Ink and Chemicals, Inc., Japan, HYDRAN AP-20, solid content 30%)

A coating liquid, for a dye-receptive layer, having the following composition was gravure-coated at a coverage of 3 g/m$^2$ on the barrier layer, and the coating was dried by a hot air drier to form a dye-receptive layer. Thus thermal transfer image-receiving sheets of Examples 1 to 5 were prepared.

Coating Liquid for Dye-receptive Layer

| | |
|---|---|
| Vinyl chloride/vinyl acetate copolymer (manufactured by Denki Kagaku Kogyo K.K., Japan #1000D) | 100 parts |
| Amino-modified silicone (manufactured by The Shin-Etsu Chemical Co., Ltd., Japan, X-22-349) | 3 parts |
| Epoxy-modified silicone (manufactured by The Shin-Etsu Chemical Co., Ltd., KF-393) | 3 parts |
| Methyl ethyl ketone/toluene = 1/1 | 400 parts |

COMPARATIVE EXAMPLE 3

A thermal transfer image-receiving sheet of Comparative Example 3 was formed in the same manner as in Example 1, except that no barrier layer was formed.

COMPARATIVE EXAMPLE 4

A thermal transfer image-receiving sheet of Comparative Example 4 was formed in the same manner as in Example 2, except that the barrier layer was formed of polyvinyl alcohol alone.

COMPARATIVE EXAMPLE 5

A thermal transfer image-receiving sheet of Comparative Example 5 was formed in the same manner as in Example 3, except that the barrier layer was formed of polyurethane alone.

The thermal transfer image-receiving sheets of Examples 1 to 5 and Comparative Examples 1 to 5 were evaluated by the following methods. The results are summarized in the following Table 1.

(1) Print quality

A dye sublimation type thermal printer (Rainbow 2720) manufactured by Sumitomo 3M Ltd. and a specialty thermal transfer sheet for the above printer were used to form solid images of four colors of yellow, magenta, cyan, and black (gradation 64/256 for each color) on the image-receiving sheets of the examples and comparative examples, and the images were visually inspected.

○: Good image free from dropouts and unevenness

Δ: Some defect observed

X: Significant dropouts and unevenness (2) Sensitivity in printing

A dye sublimation type thermal printer (Rainbow 2720) manufactured by Sumitomo 3M Ltd. and a specialty thermal transfer sheet for the above printer were used to form a solid image of magenta (gradation 256/256) on the image-receiving sheets of the examples and comparative examples, and the reflection density was measured with a Macbeth densitometer RD-218.

○: Reflection density of not less than 1.7

Δ: Reflection density of 1.5 to 1.7

X: Reflection density of less than 1.5

(3) Interfacial adhesion between barrier layer and dye-receptive layer

A mending tape (manufactured by Sumitomo 3M Ltd.) was applied onto the surface of the dye-receptive layer of the image-receiving sheets of the examples and comparative examples. One min after the application of the mending tape, the mending tape was separated and removed, and the surface of the receptive layer and the mending tape were visually inspected and evaluated.

○: Dye-receptive layer not separated at all

Δ: Dye-receptive layer separated in places where the tape had been applied

X: Dye-receptive layer separated in the whole area where the tape had been applied

TABLE 2

Evaluation of results

| Sample | Print quality | Sensitivity in printing | Interfacial adhesion between barrier layer and dye-receptive layer |
|---|---|---|---|
| Comp. Ex. 1 | Δ | Δ | ○ |
| Ex. 1 | ○ | ○ | ○ |
| Ex. 2 | ○ | ○ | ○ |
| Ex. 3 | ○ | ○ | ○ |
| Comp. Ex. 2 | Δ | Δ | Δ |
| Comp. Ex. 3 | X | X | — |
| Comp. Ex. 4 | Δ | ○ | X |
| Comp. Ex. 5 | X | X | ○ |

As is apparent from the foregoing description, according to the present invention, provision of a barrier layer, comprising polyvinyl alcohol and a polyurethane resin in a weight ratio on solid basis of polyvinyl alcohol to polyurethane resin of 10:100 to 80:100, between a heat-insulating, porous layer and a dye-receptive layer provided on a paper substrate can realize a thermal transfer image-receiving sheet that can produce an image having high density and high quality and is free from separation between layers at the time of tape peeling.

What is claimed is:

1. A thermal transfer image-receiving sheet comprising: a paper substrate; and, provided on the substrate in the following order, a heat-insulating, porous layer composed mainly of a resin, a barrier layer, and a dye-receptive layer, the barrier layer comprising at least a mixture of polyvinyl alcohol with a polyurethane resin, the weight ratio on solid basis of polyvinyl alcohol to the polyurethane resin being 10:100 to 80:100.

2. The thermal transfer image-receiving sheet according to claim 1, wherein the heat-insulating, porous layer has been formed from a resin and a thermally expansive microsphere.

3. The thermal transfer image-receiving sheet according to claim 1, wherein the heat-insulating, porous layer has been formed from a resin and a capsular empty particle.

* * * * *